US005168929A

United States Patent [19]

Galloway

[11] Patent Number: 5,168,929

[45] Date of Patent: Dec. 8, 1992

[54] METHOD AND APPARATUS FOR REMOVAL OF OIL WELL PARAFFIN

[76] Inventor: Dale R. Galloway, 4650 Oak Glenn Way, Fair Oaks, Calif. 95628

[21] Appl. No.: 807,710

[22] Filed: Dec. 16, 1991

[51] Int. Cl.[5] ..... E21B 37/04

[52] U.S. Cl. ..... 166/304; 166/60; 166/65.1; 166/170; 166/174; 166/302; 166/311

[58] Field of Search ..... 166/304, 302, 311, 170, 166/174, 60, 62, 65.1, 177

[56] References Cited

U.S. PATENT DOCUMENTS

| | | | |
|---|---|---|---|
| 3,058,525 | 10/1962 | Humphries | 166/177 |
| 3,171,487 | 3/1965 | Ault | 166/170 |
| 3,251,306 | 5/1966 | Plunk | 166/170 X |
| 3,329,211 | 7/1967 | Roach | 166/170 |
| 3,394,763 | 7/1968 | Page, Jr. | 166/170 |
| 3,438,444 | 4/1969 | Wilkerson | 166/60 X |
| 3,680,635 | 8/1972 | Berry et al. | 166/300 |
| 4,034,807 | 7/1977 | Prince et al. | 166/170 |
| 4,538,682 | 9/1985 | McManus et al. | 166/304 X |
| 4,603,739 | 8/1986 | Krugh | 166/170 |
| 4,790,375 | 12/1988 | Bridges et al. | 166/60 |
| 4,809,778 | 3/1989 | Johnson | 166/304 X |
| 4,911,239 | 3/1990 | Winckler et al. | 166/302 |
| 4,911,240 | 3/1990 | Haney et al. | 166/304 |

*Primary Examiner*—Hoang C. Dang
*Attorney, Agent, or Firm*—George W. Wasson

[57] ABSTRACT

An oil well tool and method for its use for removing accumulated deposits along an oil well tubing in a downhole pump operated oil well is disclosed. The tool when in use is untethered and adapted to be lowered through an oil well tubing under its own weight and the forces of gravity. The tool includes: a heating and scraping portion that removes the deposits as the tool is lowered through the tubing, a set of seals for preventing pumped fluids from passing through or around the tool, and a mechanism for setting the seals at a desired location along the tubing. With the seals set and the pump operating, the tool is raised up through the well tubing with the pumped fluids to a wellhead storage position.

16 Claims, 4 Drawing Sheets

METHOD AND APPARATUS FOR REMOVAL OF OIL WELL PARAFFIN

This invention relates to oil well servicing and more particularly to a method and apparatus for removal of accumulated substances including paraffin deposits along an oil well tubing. The invention has particular application to oil wells having a fluid pump at or near the downhole bottom of the well with oil well tubing extending from the downhole pump to a wellhead at the surface of the oil well.

The invention has particular application to low production wells frequently referred to as stripper wells. Stripper wells are so named because such wells operate to produce or strip some of the last remaining petroleum from older produced formations and usually are wells of low volume production where the produced fluids pass slowly through the well to the wellhead. The invention is applied to wells having downhole pumps near the producing zone rather than to wells referred to as rod pumped wells. In wells having downhole pumps, the pumps may operate continuously or at intervals after the formations have produced enough fluids to permit the fluids to be pumped to the surface. The interior surface of production tubing of a well having a subsurface pump is generally smooth and uninterrupted, except for couplings, so that fluids will pass through the interior of the tubing to the wellhead. Any accumulation or obstructions along the interior of the tubing can restrict fluid flow through the tubing and impede the production of petroleum at the wellhead.

BACKGROUND OF THE INVENTION

Petroleum crude oil contains many constituents that can precipitate from the crude as it moves from the producing formation to the wellhead. One of those constituents is paraffin. The accumulation of paraffin within the production tubing of a working oil well is a major problem experienced throughout the petroleum industry. While the paraffin content of crude oil is variable, virtually all petroleum contains some paraffin that can result in the solidification of paraffin within the production tubing as the produced fluids travel from a downhole producing zone to the surface termination of the production tubing at a wellhead. As the buildup of solidified paraffin along the production tubing progresses, the ability to produce fluids through the tubing diminishes and eventually, in the worst case, the production tubing may become plugged to the point of preventing any flow of fluids. Plugging of the production tubing with substances found in the produced fluids including paraffin deposits requires servicing of the well for removal of the deposits before production of fluids can be resumed.

While paraffin may occur in most petroleum crude oil, the paraffin in each crude oil may have different characteristics and, in particular, may have a different melting temperature (or cloud point temperature). The temperature and pressure conditions will change along the passage of fluids from the producing zone within the formation through production tubing and the paraffin may solidify on the production tubing as the fluid cools in its travels to the wellhead.

A somewhat typical oil well temperature profile may show a temperature of 200° F. at 12,000 feet of depth within the well, a temperature of 170° F. at 7,000 feet of depth and a continued temperature reduction to the wellhead. If the produced fluids passing upward through the tubing in such a well contains paraffin having a cloud point lower than 170° F. it would be possible for paraffin deposits to accumulate along the inner wall of the tubing at any location where the temperature is lower than 170° F. Continued accumulation of deposits could cause the well tubing to become blocked.

Many alternatives have been proposed for the prevention of paraffin buildup or the removal of paraffin deposits from production tubing including mechanical, chemical and electrical systems to keep the paraffin buildup from interferring with the production of fluids through the production tubing. Some of the alternative proposals are permanent installations within the producing well while others are proposals for a servicing apparatus that is inserted through the wellhead and lowered to the tubing position needing servicing. Most well servicing tools or apparatus are tethered on a wire line, a tubing or a rod that lowers the tool through the wellhead to the servicing location cleaning the interior of the production tubing as the tool is lowered into the well or as the tool is raised to the wellhead.

Petroleum wells may have well casing and production tubing within the casing and, in some wells, the production tubing may further include other tubings or rods that are inserted within the production tubing. When a plugged well tubing is serviced, some of the tubings within the production tubing must be removed to permit the entry of servicing tool. The process of removing tubing from a well bore, the insertion of a servicing tool and return of the tubing to put the well back into production is both time consuming and expensive. Most well servicing requires the use of well servicing rig or service company and an interruption of production through the well as the rig is put into place and a servicing tool is run into and out of the well.

In light of the foregoing background information, it has become apparent that there is a need for a method and apparatus for providing inexpensive and dependable removal of paraffin buildup along the interior of production tubing in a petroleum well. Further, it would be desirable to provide an apparatus that may be placed into a well tubing without the need of a servicing rig and without the need for extended interruption of production from the well.

SUMMARY OF THE INVENTION

In accord with the present invention a method and apparatus is disclosed wherein an apparatus for removing paraffin from well bore tubing may be stored at a wellhead or inserted into a production tubing at the wellhead of a petroleum well for servicing the well. The apparatus is not tethered to the wellhead when in use and is free to be released for movement down through the production tubing to a downhole location and, after being controlled to perform a function in its travel to a downhole location, is then transported to the wellhead with the produced fluids passing upwardly through the production tubing. The apparatus is them returned to a storage position or removed and placed in ready condition for another passage into the well tubing.

The apparatus of the present invention includes a source of power, a heating and scraping element, a temperature sensing element and a seal setting element and the heating and scraping portion includes a scraper or cutter that contacts accumulated paraffin or other deposits along the tubing. The apparatus is smaller in exterior diameter than the interior diameter of the production tubing so that it is free to move down the tubing to a downhole location. Wellbore fluids are able to flow partially through the apparatus and around the annulus between the apparatus and the interior of the tubing. A portion of the apparatus is heated as the apparatus passes downwardly through the well tubing to cause removed paraffin deposits to be heated to a temperature above the cloud point of the paraffin. The paraffin is thus released from the inner surface of the tubing. As the apparatus passes downwardly through the tubing toward the producing zone of the well it encounters well bore fluids of increasing temperature. The temperature sensing element within the apparatus is set to a predetermined temperature for actuation of a seal setting element. The predetermined temperature is a temperature above the cloud point of paraffin within the well bore fluids. When that temperature is sensed, the seal setting apparatus is actuated and a seal prevents well bore fluids from passing around or through the apparatus. The apparatus moves upwardly through the tubing with pumped produced fluids. Energization of the heating element is interrupted at that time.

The object of the present invention is an apparatus and a method for its operation that will permit the apparatus to be self lowering through a well production tubing to a downhole location, the apparatus is energized to heat and remove deposits along the tubing in the travel down the tubing and, when a predetermined temperature for the fluids has been sensed, the heater element energization is terminated and seal setting elements of the apparatus then may be self setting to prevent fluids from flowing through or around the apparatus so as to cause the apparatus to flow up the tubing with produced fluids to the wellhead.

A further object in accord with the preceding object is an apparatus that may be stored at the wellhead of a producing well in a position to be releaseable into the well tubing and to be returnable to the storage position without interruption of the production of fluids through the well tubing.

Other objects and features of the present invention will be readily apparent to those skilled in the art from the appended drawings and specification illustrating a preferred embodiment wherein:

DETAILED DESCRIPTION OF THE PREFERRED EMBODIMENT

Figure 1:
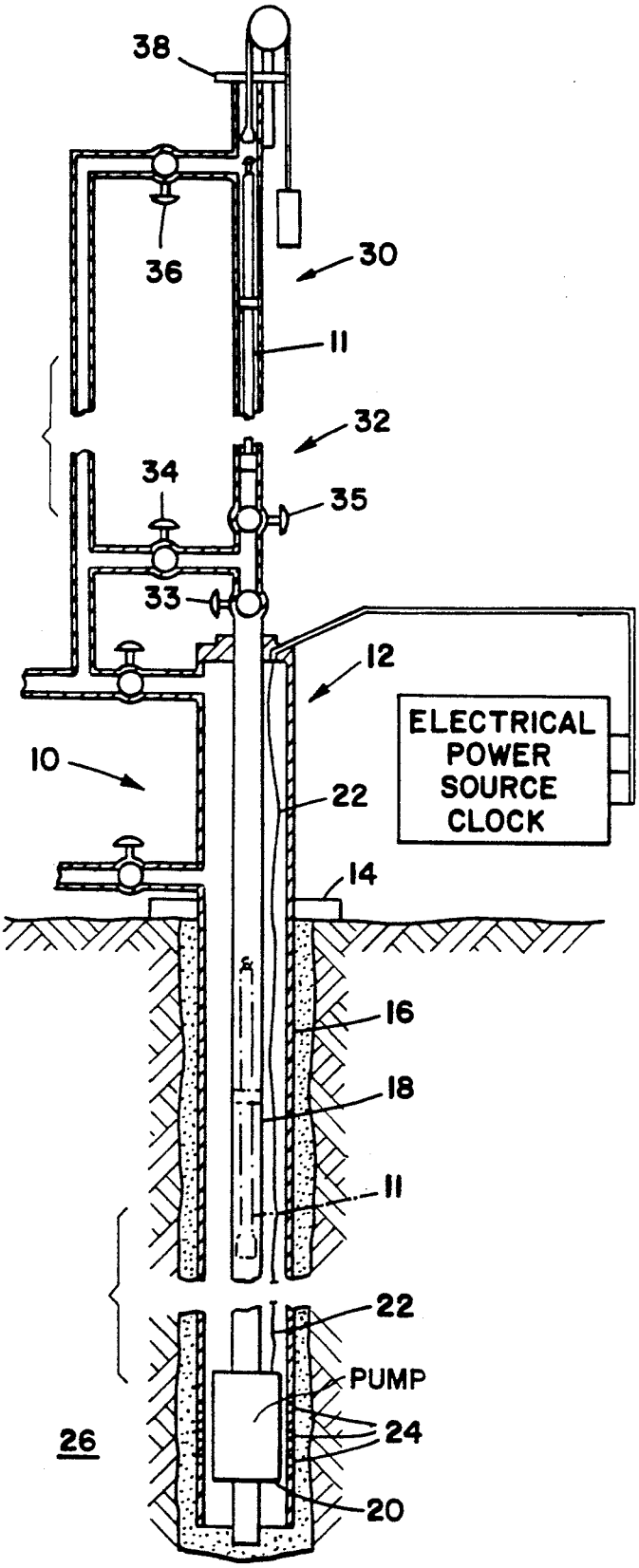
FIG. 1 is a sectional, schematic view of an oil well illustrating the general well elements adapted to accomodate the apparatus of the present invention.

The present invention is directed to an apparatus and a method for using that apparatus in the removal of accumulated deposits including paraffin from an oil well, a preferred embodiment of which is shown in FIG. 1 in a schematic illustration of a well. While the major portion of this description will be directed to the removal of accumulated paraffin deposits, it should be understood that the apparatus is capable of removing other removal accumulation. As illustrated in FIG. 1, a well 10 such as might be used for the production of fluids containing petroleum crude includes a wellhead assembly 12 with schematic illustration of a surface plate 14 for the support of downhole and surface elements.

In the schematic illustration of FIG. 1 the downhole elements include a casing 16 and production tubing 18. A pump 20 is located at the extreme downhole end of the tubing 18 with wiring 22 passing from the wellhead to the pump in the annulus between the tubing 18 and the casing 16. The casing 16 is cemented to the formation along the well bore to a completion or producing zone where the casing is slotted or perforated at 24 to permit produced fluids to flow from the formation 26 into the casing for movement to the wellhead in the tubing 18 under pump pressure from the pump 20. It should be understood that appropriate filters may be needed between the casing and the pump and that other forms of downhole completions may be used, the completion here shown forms no part of the present invention and is merely shown as a way in which formation fluids may pass from the formation 26 to the pump 20 and the production tubing 18 to the wellhead 12.

As illustrated in FIG. 1, the tool apparatus 11 of the present invention is shown in a stored position in the wellhead tubing and is shown, in phantom, in a functional position within the tubing 18 between the wellhead assembly 12 and the downhole pump 20.

At the uphole portion of the wellhead assembly 12, a storage chamber 30 is illustrated as attached to the wellhead assembly 12 axially above the tubing 18. The storage chamber 30 is of adequate length to accomodate the tool apparatus 11 of the present invention in a manner to be described hereinafter. A valve and piping assembly 32 including a close-off valve 33 is provided between the surface plate 14 and the storage chamber 30; the valve and piping assembly 32 will permit the tool apparatus to pass into the storage chamber 30 and them permit the storage chamber to be isolated from the production tubing. A valve 34 permits the passage of produced fluids from the valve assembly and a bypass valve 35 permits the tool 11 and produced fluids to flow into and through the storage chamber to carry the tool assembly to stored position before close-off valve 33 is closed. Valve 36 isolates the storage chamber from produced fluids. The upper portion of the storage chamber 30 may be capped with a cap 38 that will permit access to the tool apparatus for servicing or removal and may provide for access to the downhole portions of the production tubing for servicing the well tubing or other downhole elements.

Figure 2:
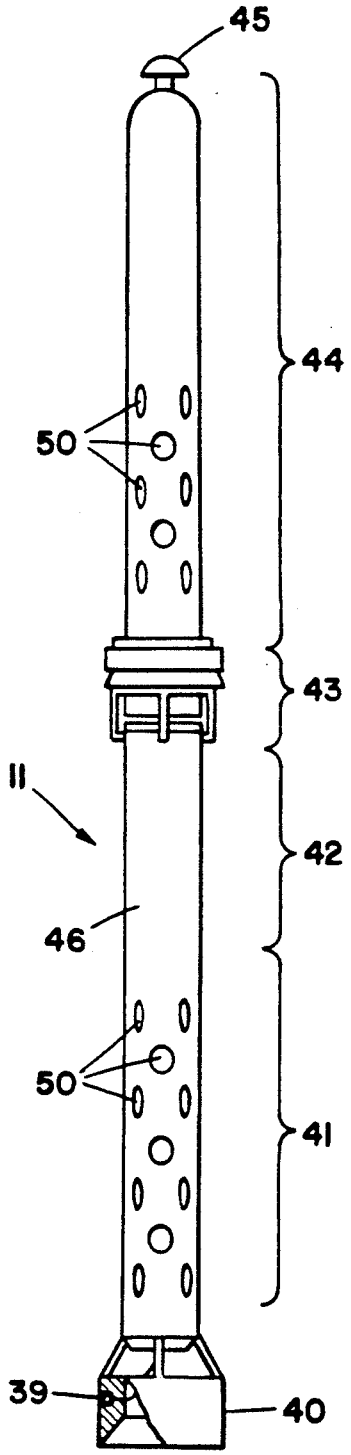
FIG. 2 is an elevational view of the apparatus of the present invention removed from a well.

FIG. 2 is a sectional illustration of the tool apparatus 11 showing the major outline of the components of the tool including the paraffin cutting and heating element 40, the temperature sensing portion 41, the seal actuating portion 42, the exterior and interior seal portion 43, and the power source and electrical control portion 44. Each of these portions will be described hereinafter. At the top of the tool apparatus a connector 45 is provided for attachment of a hoist cable for moving the apparatus into the storage chamber 30, for retrieval of the apparatus from the well tubing or from the storage chamber.

The tool apparatus 11 is an elongated tubular member 46 having an exterior diameter dimension that is less than the interior diameter dimension of the production tubing in the well where the apparatus is to be used. The tubular member 46 includes passages 50 for well bore fluids to flow through the tool until those passages are sealed. Before seals are set by operation of the apparatus, well bore fluids may pass partially through the apparatus and partially around the exterior of the apparatus.

The heating and scraping element 40 of the apparatus is powered from the power source and control portion 44 and is adapted to scrape and heat paraffin deposits accumulated along the tubing contacted by the element 40. The tubular housing around the temperature sensing portion is perforated at 50 to permit well bore fluids to pass into contact with a sensing element within the tubular portion. The temperature sensing portion is adjusted to trigger a spring biased seal setting actuator in portion 42 when well bore fluids of a predetermined temperature are encountered. The actuator portion 42 causes seals to be set in the interior and exterior seal portion 43 to prevent fluids from flowing through the interior of the apparatus and in the annulus between the tool assembly and the interior of the production tubing. With the seals set to prevent well bore fluids from flowing through or around the tool apparatus and with the pump 20 operating, the tool assembly is carried upwardly through the production tubing 18 with the produced fluids.

Figure 3:
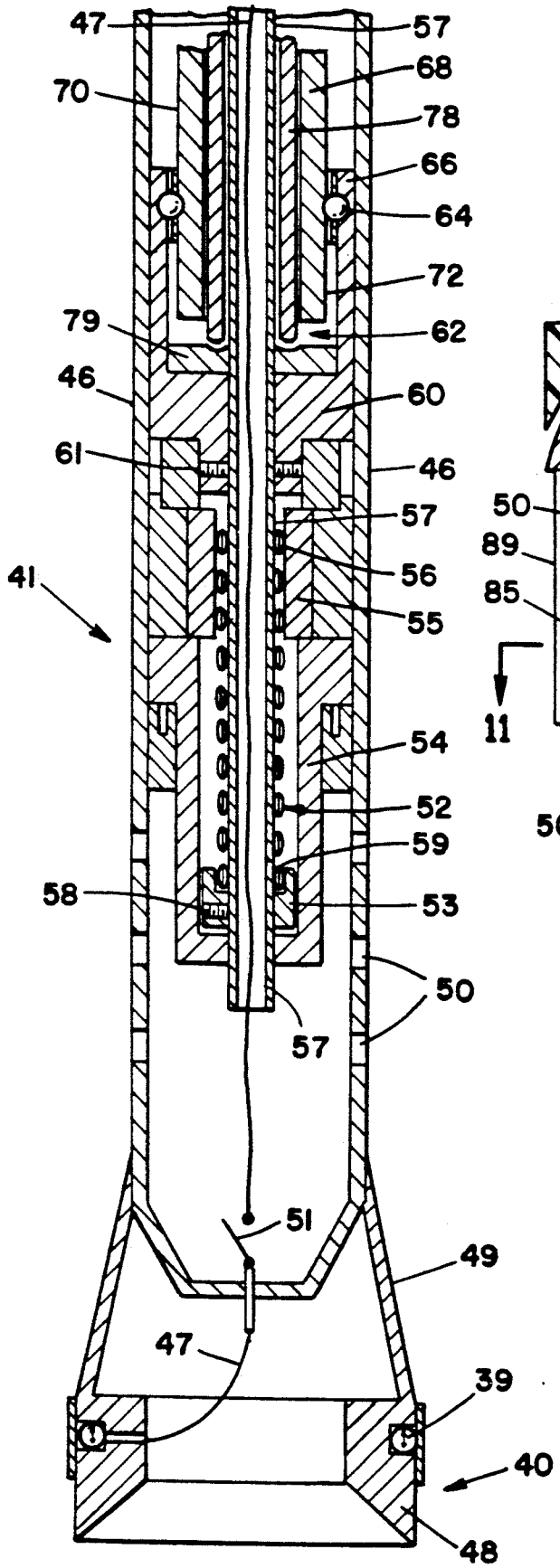
FIG. 3 is a sectional view of the heating and scraping portion, the temperature sensing portion, and the triggering portion of the present invention.

FIG. 3 illustrates in cross-section the heating and scraping element 40 and temperature sensing portion 41 of the tool apparatus 11. The tool apparatus 11 includes the tubular member 46 made of several joined tubes of the same diameter and the same centerline to enclose the several elements of the tool. At the heating and scraping element portion 40, a paraffin cutting or scraping ring 48 is suspended from the tubular member 46 on struts 49 and a heater unit 39 within the ring 48 is powered through conductors 47 and switch 51 from the power source portion of the tool. Switch 51 is a temperature sensitive switch having a temperature at which it closes and a temperature at which it opens. The switch is adapted to control energization of the heater unit 39 to cause heating of the cutting or scraping ring 48 to a controlled range of temperatures; those temperatures being predetermined as the range of temperatures for heating paraffin accumulated along the tubing to a flowable condition. The scraped and heated paraffins rise under thermal agitation and pump action to pass along the well tubing to the wellhead.

The temperature sensing portion 41 of the tool apparatus 11 is contained within the tubular member 46 above the heating element 40. At this portion of the tubular member 46 there are perforations 50 cut through the tubular portion so that the well bore fluids flow into the interior of the sensing portion. Part of the sensing portion is a standard oil well item and may be the form available from Kuster Company, P.0. Box 90909, Long Beach, Calif. 90809-0909, in the form known as K3T Temperature Gauge. The K3T Temperature Gauge is modified for use in the present invention by providing an interior hollow center passageway for electrical power and control conductors 47 between the power source and electrical control portion 44 and the heater unit 39. The K3T Temperature Gauge in the form used herein includes a coiled bimetal element 52 having its lower end 59 fixed in a collar 53 and the collar 53 is attached to a hollow central tubing 57 by suitable means such as set screws 58. The coiled bimetal element 52 responds to temperature changes and converts those changes to rotary motion of one end of the coil with respect to the other.

The central tubing 57 extends through the center of the coiled bimetal element 52 and functions as a conduit for conductors 47. The upper end 56 of the bimetal element 52 is contained within the bottom interior of coil shield 54 and is fixed by suitable means (not shown) to a coil shield retaining shoulder 55 threaded to interior threads in the tubular member 46. The support of the bimetal element 52 within the tool apparatus on the shoulder 55 fixes the upper end 56 of the bimetal 52 to the tool assembly while the lower end 59 of the bimetal is free for rotary movement of the collar 53 and rotation of the tubing 57 with respect to the axis of the tool. The operation of the temperature sensing portion 41 of the tool is to sense the temperature of the well bore fluids and to convert that temperature to rotary movement of the free end of the bimetal element; that rotary movement being used to trigger the seal setting portion 42 of the tool.

The upper or rotatable end of the tubing 57 rotated by the bimetal element 52 is housed within bearings, spacers and housings within tubular member 46 and passes through a portion of a trigger housing 60 with the tubing 57 attached by suitable means, such as set screws 61, to a portion of the housing 60. The housing 60 is rotatable within the tubular member 46 with rotary movement of the tubing 57 and bimetal element 52. The housing 60 includes an internal annular portion 62 for support of a trigger lock. The trigger lock includes trigger lock balls 64 held in a trigger lock collar 66 within the annular portion 62. The housing 60, collar 66 and lock balls 64 are rotatable with the tubing 57 as driven by bimetal 52.

As shown at the upper end of FIG. 3 and in FIGS. 6–10, a trigger tubing 68 extends into the annular portion 62 of the trigger lock. The end of the trigger tubing 68 within the annular portion 62 includes a pair of axial flats 70 aligned with the trigger lock balls 64 and the axial flats 70 are further formed with annular extensions 72 into the cylindrical portion of the trigger tubing 68. The flats 70 and extensions 72 are adapted to cooperate with the balls 64 to releasably lock the trigger tubing 68 within the annular portion 62 by the action of insertion and rotary motion of the trigger tubing. Reverse relative rotary motion between the tubing 68 and the trigger housing 60 then permits the tubing 68 to be released from the portion 62 when the balls 64 become aligned with the flats 70. That reverse relative rotary motion of the trigger housing is driven by the rotary movement of the tubing 57 caused by action of the bimetal element 52.

Figure 4:
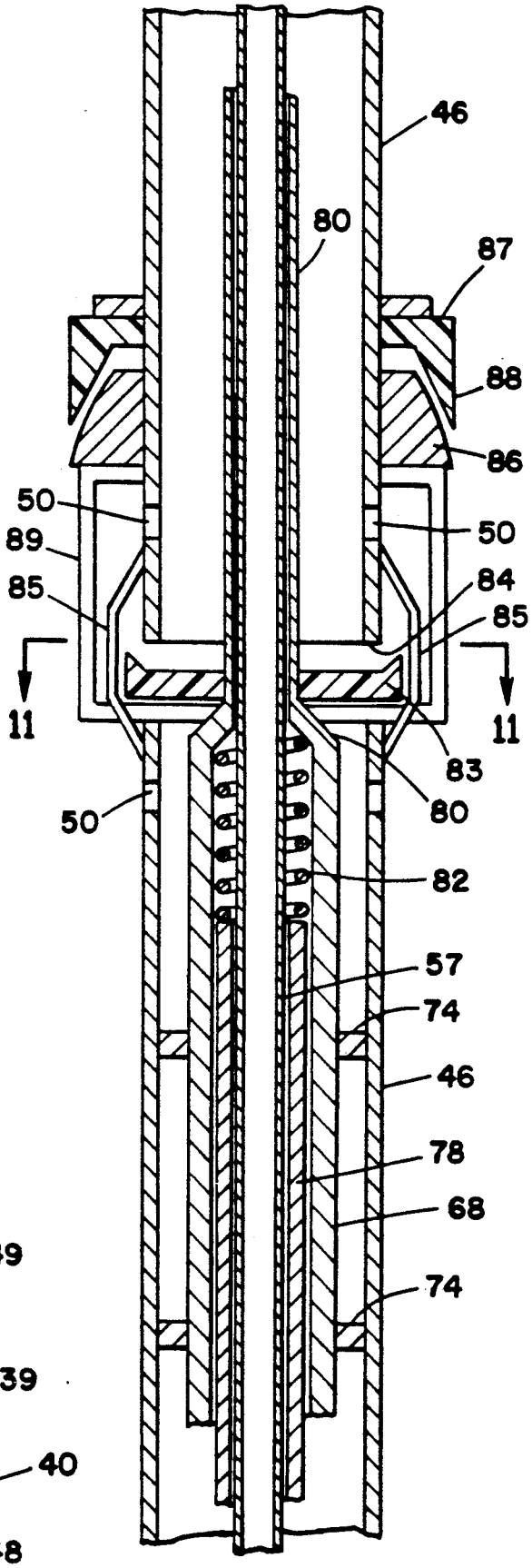
FIG. 4 is a sectional view of the seals and the seal setting actuator portion of the present invention.

Referring now to FIG. 4 showing the seal setting actuator section of the apparatus, the trigger tubing 68 is shown within the center of tubular member 46 in a centralized position by slidable centralizers 74. Within the interior of the trigger tubing 68, in freely slidable positions, is the hollow central tubing 57 for enclosing power and control cables from the power source and electrical control elements 44 and, surrounding the tubing 57, is a sliding tubing 78. The upper end of the trigger tubing 68 has a reduced diameter extension portion 80 and a seal setting spring 82 is enclosed between the inside of the trigger tubing 68 and the outside of tubing 57. The upper end of the sliding tubing 78 engages one end of the seal setting spring 82 within the trigger tubing 68 and the other end of the seal setting spring 82 is contained within the trigger tubing 68 at the reduced diameter extension portion 80. The extension portion 80 is slidable along the conduit tubing 57.

The tubing 57 passes through the seal setting actuator portion and trigger housing 60. The lower end of the sliding tubing 78 engages the interior base of the trigger housing 60 at thrust bearing 79 (FIG. 3) and the upper end engages the seal setting spring (FIG. 4). Axial movement of the trigger tubing 68 toward the trigger housing 60 with the trigger lock balls 64 aligned with the axial flats 70 causes the spring 82 to be compressed and when accompanied by rotary movement of the tubing 68 sets the trigger lock balls 64 within the annular extensions 72 to hold the seal setting spring 82 compressed within the upper end of the trigger tubing 68 to bias the trigger tubing and its extension 80 for axial movement away from the trigger housing 60 when released from the trigger housing 60.

As shown in FIG. 4, above the spring containing portion of trigger tubing 68 and at the beginning of the reduced diameter portion 80, the exterior and interior seals of the present invention are mounted and operated by the previously described elements. It should be understood that prior to setting the seals, the flow of wellbore fluids can be through the interior of the apparatus through holes 50 in the tubular member 46 and along the annulus between the inside of the tubular member 46 and the exterior of the trigger tubing 68 and its reduced diameter extension 80, then out of the interior of the apparatus through holes 50 above the sealing section. The wellbore fluids may also pass along the exterior of the apparatus in the annulus between the apparatus and the interior of the production tubing 18. The function of the sealing section of the apparatus is to close both of these possible passages for wellbore fluids so that the apparatus will be transported up the well bore with the fluids. The operation of the sealing section is to create a one-way flow control device within the apparatus.

Figure 13:
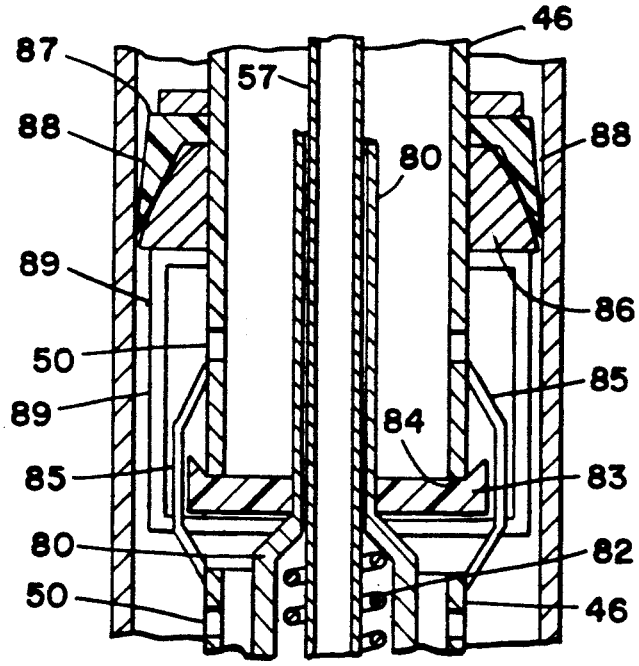
FIG. 13 is a sectional view illustrating the present apparatus with seal in set position.
Figure 6:
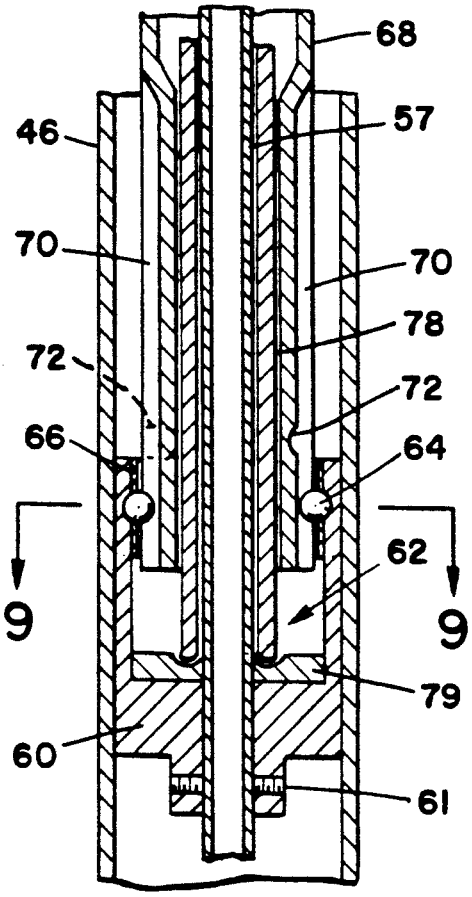
FIG. 6 is a sectional view through the triggering portion of FIG. 3 with the trigger in unlatched position.
Figure 8:
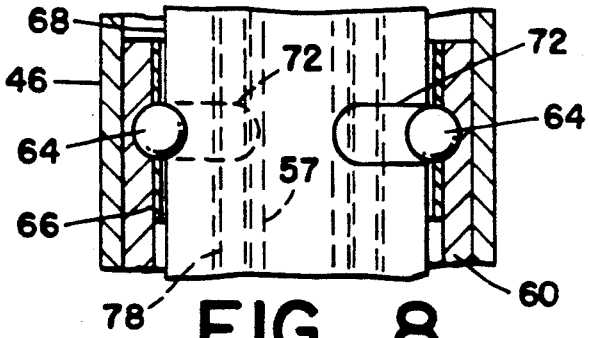
FIG. 8 is an enlarged elevational view of the latching configuration of the trigger portion of FIG. 3.
Figure 9:
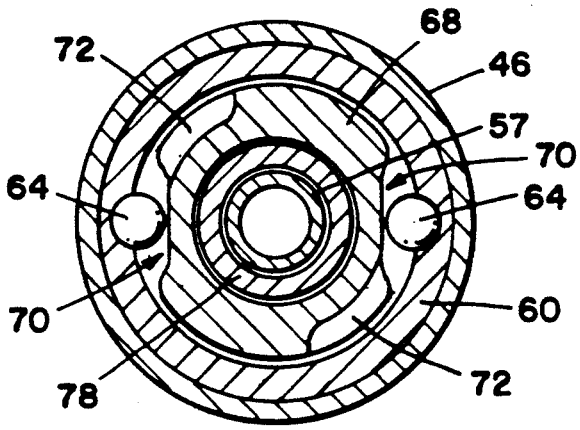
FIG. 9 is a sectional view along the lines 9—9 of FIG. 6.
Figure 7:
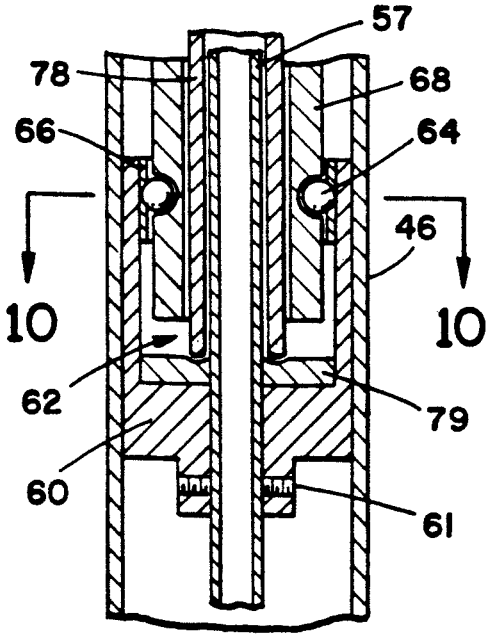
FIG. 7 is a sectional view similar to FIG. 6 showing the trigger in latched condition.
Figure 10:
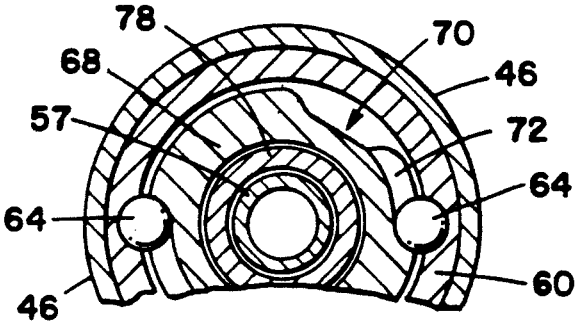
FIG. 10 is a sectional view along the lines 10—10 of FIG. 7.
Figure 11:
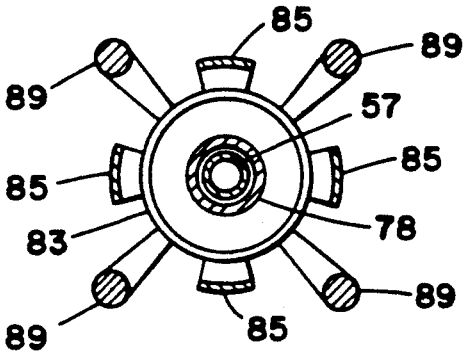
FIG. 11 is a sectional view along the lines 11—11 of FIG. 4.

The closing of the interior passageway for fluids is accomplished by moving an interior seal 83 from its latched position as shown in FIG. 4 to its sealing position as shown in FIG. 13. Sealing is accomplished by forcing the seal 83 against the stationary seal surface 84 along the tubular member 46. The tubular member 46 is interrupted at the sealing position with the upper portion joined to the lower portion by a plurality of braces 85 as shown in FIG. 11. The seal 83 operates within the space provided by the braces 85.

The closing of the exterior passageway for fluids is accomplished by moving a male solid seal operator 86 against a flexible female interior cup seal 87 from the positions shown in FIG. 4 to the positions of FIG. 13. Sealing is accomplished by moving the male seal operator 86 into the interior of the female cup seal 87 and thus forcing the cup surface 88 radially outwardly into contact with the interior of the production tubing 18. The male seal operator 86 is moved by strut members 89 which are fixed, by suitable means, at one end to the trigger tubing 68 at the reduced diameter portion 80 and at the other end to the interior of the seal operator. The struts, as shown in FIG. 11, are spaced with respect to the braces 85 so that neither interferes with the other. The flexible female interior cup seal 87 is attached, by suitable means, to the tool apparatus 11 at the exterior of the tubular member 46. It should be noted that the movement needed to close the exterior seal by moving the male operator 86 into the female cup seal 87 is the same amount of movement that is needed to close the interior seal 83 against the seal surface 84.

Figure 5:
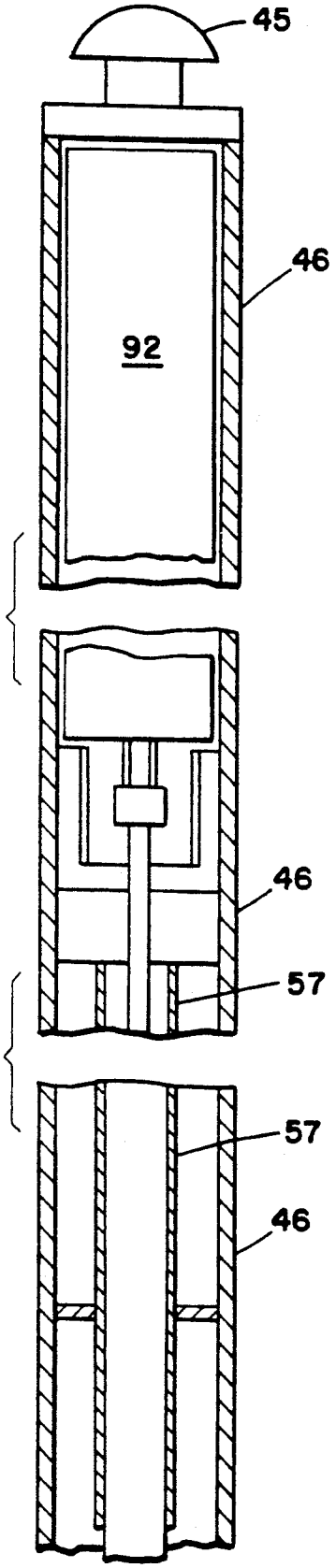
FIG. 5 is a sectional view of the power source and electrical control portion of the present invention.

FIG. 5 illustrates, in section, the power source and electrical control portion of the present invention. The apparatus is intended to be operated by a battery source and associated electrical controls 92 that will provide enough power to heat the heater unit 39 to accomplish cleaning of the interior of the production tubing as the tool is lowered through the tubing under the force of gravity. The control section may include pressure sensitive mechanisms that could control the operation of the seal setting portion of the tool as well as controlling the operation of the heater element to keep the heater at temperatures within a desired range. Shown at the upper end of FIG. 5 is a connector 45 that may be used in moving the apparatus into a storage position as shown in FIG. 1 or in retrieving the apparatus from a well should it become stuck or inoperative.

Figure 12:
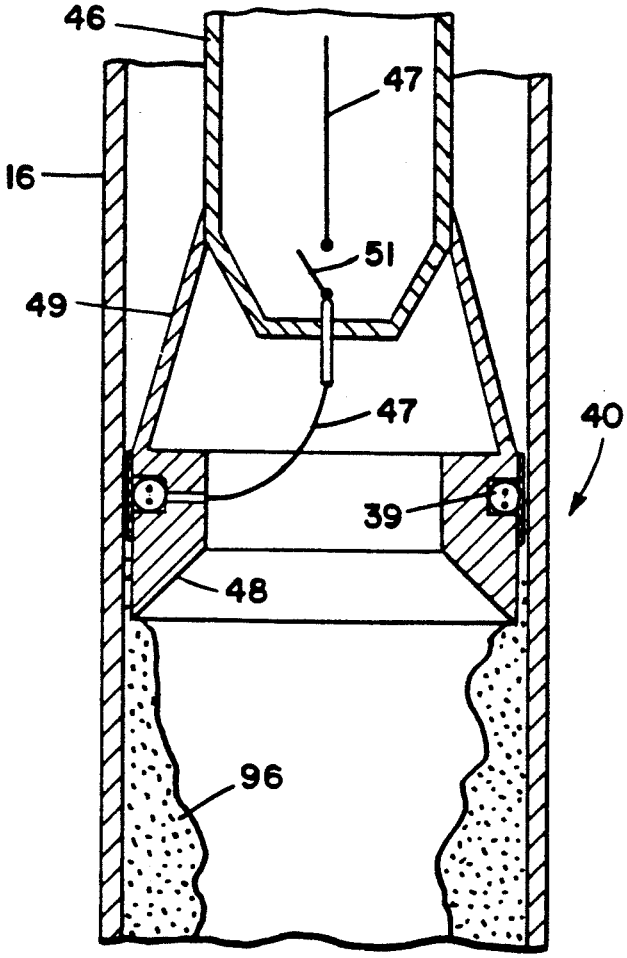
FIG. 12 is a sectional view through an oil well tubing illustrating schematically the accumulated paraffin along the tubing and the removal of that paraffin with the apparatus of the present invention.

The operation of the apparatus of the present invention should be apparent from the foregoing description of the assembly. FIGS. 12 and 13 illustrate the apparatus in use in a well tubing. FIG. 12 illustrates the cleaning and paraffin removal as the tool is lowering into the tubing and shows the heating and cutting unit 40 of the tool with the heater element 39 heating the cutting or scraping ring 48. Accumulated paraffin is schematically illustrated at 96 below the tool and a generally cleaned interior is shown for the tubing above the heating and cutting unit 40. FIG. 13 illustrates the seals of the apparatus set to stop flow of wellbore fluids through or around the apparatus. The interior seal 83 is set against the seal surface 84 of the tubular member 46 to prevent produced fluids from flowing upwardly through the interior of the apparatus. The exterior seal is shown in its set position with the cup surface 88 of the exterior seal forced against the inner surface of the production tubing 18 to form a generally fluid tight seal preventing fluids from flowing around the seal. The engagement of the cup surface 88 against the interior of the tubing 18 is not so tight as to prevent movement of the apparatus upwardly through the tubing as produced fluids are pumped upward through the tubing. Both the interior and exterior seals are set by a release of the trigger tubing 78 from its latched position within the trigger housing.

In operation, the tool is lowered by the force of gravity down through the production tubing cleaning and scraping the interior surface of the production tubing as it travels down through the tubing. The produced fluids pass upwardly through the apparatus through the holes 50 and raise the temperature of the bimetal element 52 to the temperature of the fluids. Before being lowered into the tubing 18, the trigger portion of the tool is set by compressing spring 82 and locking the trigger tubing in place with the balls 64 captured within the annular extensions 72, the seals 83 and 88 are open, and the heating and scraping element is set to operate at a desired location or within a preset temperature range. When the bimetal element 52 encounters fluids of higher temperature its movable end rotates and carries the trigger housing 60 with it until it has rotated enough to move the locking balls 64 along the annular extensions 72 until the balls become aligned with the axial flats 70 at which time the bias of spring 82 causes the trigger tubing 68 to be forced toward the upward end of the apparatus 11. Movement of the trigger tubing 68 and its end 80 carries the struts 89 to close the exterior seal by moving the male portion 86 into the female portion 87 to move the cup surface into contact with the interior of the production tubing 18. The movement of the trigger tubing 68 and its end 80 also forces the interior seal 83 against the seal surface 84 to close the interior of the apparatus. The annulus between the tool 11 and the production tubing 18 is then sealed and the interior of the tool 11 is sealed by the action of the interior and exterior seal portion 43 and, as the produced fluids are forced upwardly through the tubing 18, the apparatus 11 moves with the fluids.

When the apparatus 11 has reached the wellhead 12 it is passed through the wellhead valves into the storage tubing 30 where it may be stored or retrieved for servicing in preparation for another use in the same well or for movement to another well where accumulation of paraffin or other deposits is a problem.

It should be understood that the tubular member 46 may be made up of several tubular elements that are threaded together to contain the working elements of the apparatus. Within one of the portions of the tubular member 46 the bimetal element may be adjusted for operation within selected ranges. The coil shield 54 that holds the fixed end of the bimetal element 52 within the collar 53 may be positioned in rotational position with respect to the tubular member 46 to establish the temperature at which the bimetal will release the the trigger tubing 68 from the trigger housing 60. Before the apparatus is lowered into the production tubing of any well, the trigger mechanism must be compressed and rotated to latch the trigger tubing 68 within the housing 60 to hold the seals open during the travel of the apparatus into the tubing.

The present invention contemplates both the apparatus as illustrated and its modifications and the method for the use of that apparatus in removing accumulated paraffin and other deposits along the interior of a production tubing. The apparatus may also be used, with modifications providing for recording or accumulating information, to take temperature or pressure profiles along a production tubing. The apparatus could also be used with a releasable well packer or well bladder to set the packer or bladder at a desired position within a well. The temperature sensitive bimetal may have a pressure sensitive tube as a substitute with the seals being set when a particular pressure has been encountered. The advantage of the apparatus of the present invention in the method described or in the modifications here described is the ability of the apparatus to be used without well shut-down. The apparatus may be stored in the storage tubing above the wellhead in readiness for repeated uses and can perform the desired functions without the need of a service rig for lowering and retrieving a tool from a well.

While certain preferred embodiments of the invention have been specifically disclosed, it should be understood that the invention is not limited thereto as many variations will be readily apparent to those skilled in the art and the invention is to be given its broadest possible interpertation within the terms of the following claims.

I claim:

1. An apparatus for use in a well for assisting the movement of wellbore fluids from a downhole wellbore producing zone to a wellhead, said well having downhole wellbore fluid movement producing means and a wellbore fluid tubing between said downhole producing zone and said wellhead, and said wellbore fluids being subject to the deposit of removable substances including paraffin from said wellbore fluids along the interior of said tubing between said producing zone and said wellhead, said apparatus comprising:

a) an untethered elongated assembly adapted to pass within the interior of said tubing, b) said assembly including:

i) a heater and scraper element capable of scraping said removable substances and of being heated to a temperature adequate to raise the temperature of paraffin deposits along said tubing to a temperature above the cloud point of paraffin within said wellbore fluids, ii) a power source for energizing said heater and scraper element, iii) a one-way flow control device including expandable elements for engaging said interior of said tubing in sliding relationship and adapted to cause said assembly to be moved upward through said tubing with wellbore fluids moving upward within said tubing, e) and means for controlling actuation of said power source for energizing said heater and scraper element and for operating said one-way control device.

2. The apparatus of claim 1 wherein said heater and scraper element includes a scraper member and a battery powered heater ring member suspended from said elongated assembly and adapted to remove and heat paraffin deposits along at least a portion of said tubing to a temperature above the cloud point of paraffin accumulated along said tubing.

3. The apparatus of claim 2 including a controllable means for energizing said heater and scraper element, said controllable means being settable to a predetermined condition for initiating energization of said heater and scraper element and adapted to control energization of said heater and scraper element to cause said heater and scraper element to maintain said heater and scraper element within a temperature range including the cloud point of paraffin accumulated along said tubing.

4. The apparatus of claim 1 wherein said flow control device includes a settable seal element, means for setting said seal element, and a temperature sensitive element for actuating said means for setting said seal element.

5. The apparatus of claim 4 wherein said settable seal element includes an expandable element and means for expanding said expandable element, said expandable element being engagable with the interior surface of said tubing in a manner to prevent wellbore fluids from passing along said tubing in the annulus between said apparatus and said interior surface of said tubing, said means for setting said seal element includes a releasable biased portion for expanding said seal element when released, and said temperature sensitive element being in fluid contact with said wellbore fluids and adapted to release said biased portion at a predetermined temperature when said wellbore fluids contacting said temperature sensitive element are at said predetermined temperature.

6. The apparatus of claim 5 wherein said temperature element is a coiled bimetal element having one end relatively fixed to said assembly and another end rotatable to control release of said biased portion of said means for setting said seal element.

7. The apparatus of claim 6 wherein said assembly includes passageways through said assembly for flow of wellbore fluids, said passageways being open for wellbore fluid flow in fluid contact with said bimetal element, and said seal element includes means for closing said passageways when said temperature element releases said biased portion of said means for setting said seal element.

8. The apparatus of claim 1 wherein said assembly has a weight mass adequate to exceed the weight of wellbore fluids displaced by said assembly within said tubing so that said apparatus will lower itself through said tubing under the forces of gravity.

9. The apparatus of claim 1 wherein said apparatus includes an interior passageway for energization and control connection between said heater element and said means for controlling actuation of said power source for energizing said heater element and for operating said one-way flow control device.

10. An apparatus for assisting the movement of wellbore fluids through a tubing within an oil well, said tubing extending to a subsurface producing zone from the wellhead of said oil well, said tubing being subject to accumulation of paraffin deposits along the interior of said tubing as fluids are produced from said subsurface zone to said wellhead, said tubing being substantially unobstructed along its interior surface, said apparatus comprising:

a) an untethered elongated assembly having an external transverse dimension smaller than the internal transverse dimension of said tubing, b) said elongated assembly being heavier than wellbore fluids within said tubing displaced by said assembly so as to move downward through said tubing under the forces of gravity alone, c) said assembly including a heater and scraper element capable of being heated to a temperature adequate to raise the temperature of said accumulated paraffin deposits along the interior of said tubing to a temperature above the cloud point of paraffin within said wellbore fluids and to release accumulated paraffin deposits along said interior of said tubing, d) a power source within said assembly for energizing said heater and scraper element, e) an expandable element within said assembly, said expandable element being expandable to contact said interior of said tubing and being movable when expanded within said tubing with wellbore fluids as said wellbore fluids flow upward through said tubing, f) temperature sensitive means for controlling expansion of said expandable element, g) and means for controlling energization of said heater and scraper element from said power source and for expanding said expandable element whereby:

i) when said heater and scraper element is energized to heat and to release said accumulated paraffin deposits from said interior of said tubing as said untethered elongated assembly moves downward through said tubing, ii) and when said expandable element is expanded to engage said interior of said tubing, iii) said elongated assembly will move upward with wellbore fluids within said tubing to said wellhead.

11. The apparatus of claim 10 wherein said elongated assembly is adapted to be stored in an extension portion of said tubing at said wellhead in a position to permit said wellbore fluids to move through said tubing to said wellhead without moving said assembly.

12. A method for assisting in the removal of removable substances including paraffin accumulated along the interior of an oil well tubing within an oil well wherein said substances are deposited from produced fluids as said produced fluids flow through said tubing from a downhole producing zone to the wellhead of said oil well, said oil well including a pumping means for forcing flow of said produced fluids from said producing zone to said wellhead of said oil well, said method using an untethered assembly that can pass through the interior of said oil well tubing from said wellhead to a desired position along said oil well tubing, comprising the steps of:

a) positioning said assembly within the interior of said oil well tubing at said wellhead, b) releasing said assembly to permit said assembly to pass through said oil well tubing to said desired location, c) actuating a heater and scraper element within said assembly to cause at least a portion of said assembly to be heated to a predetermined temperature above the cloud point of paraffin in said produced fluids, said predetermined temperature being adequate to cause accumulated paraffin deposits along said oil well tubing to become movable with said produced fluids flowing through said oil well tubing, d) actuating a one-way flow control device forming a part of said assembly to cause said flow control device to prevent produced fluids from flowing through or around said assembly within said tubing and to cause said assembly to move with said produced fluids through said tubing, e) and returning said assembly to its position of starting within said oil well tubing at said wellhead with said pumped produced fluids flowing from said producing zone to said wellhead.

13. The method of claim 12 wherein said assembly is initially passed downward through said oil well tubing to said desired location under the forces of gravity alone.

14. The method of claim 12 wherein said assembly includes a temperature sensing device and means for actuating said one-way flow control device by said temperature sensing device, said method permitting accumulated paraffin deposits along said interior of said oil well tubing to be heated and passed through and around said assembly until said heater and scraper element has substantially removed said accumulated paraffin deposits along said oil well tubing, said temperature sensing device being exposed to produced fluids within said oil well tubing and being adapted to actuate said one-way flow control device to prevent produced fluids from passing through or around said assembly while said assembly is moved upward through said oil well tubing with said produced fluids to said wellhead.

15. The method of claim 12 with the additional step of passing said assembly to a storage position at said wellhead with said heated produced fluids, said storage position permitting said oil well tubing to be opened to flow of produced fluids without restriction by said one-way flow control device.

16. The method of claim 12 wherein said one-way flow control device is actuated when said assembly has become positioned along said oil well tubing where produced fluids are at a temperature above the cloud point for paraffin within said produced fluids.

* * * * *